US005947211A

United States Patent [19]

Jakobsson

[11] Patent Number: 5,947,211

[45] Date of Patent: Sep. 7, 1999

[54] VIBRATION-DAMPED MACHINE DRIVEN TOOL

[75] Inventor: Stefan Jakobsson, Kalmar, Sweden

[73] Assignee: Atlas Copco Berema Aktiebolag, Nacka, Sweden

[21] Appl. No.: 08/983,237

[22] PCT Filed: Jul. 4, 1996

[86] PCT No.: PCT/SE96/00913

§ 371 Date: Apr. 10, 1998

§ 102(e) Date: Apr. 10, 1998

[87] PCT Pub. No.: WO97/02929

PCT Pub. Date: Jan. 30, 1997

[30] Foreign Application Priority Data

Jul. 13, 1995 [SE] Sweden ..... 9502592

[51] Int. Cl.[6] ..... B25D 17/04; B25F 5/02

[52] U.S. Cl. ..... 173/210; 173/162.1; 173/162.2

[58] Field of Search ..... 173/162.1, 162.2, 173/170, 210, 211

[56] References Cited

U.S. PATENT DOCUMENTS

| | | | |
|---|---|---|---|
| 2,430,817 | 12/1947 | Jackson . | |
| 3,451,492 | 6/1969 | Ekstöm et al. . | |
| 4,111,269 | 9/1978 | Ottestad . | |
| 4,282,938 | 8/1981 | Minamidate . | |
| 4,673,043 | 6/1987 | Greppmair | 173/162.2 |
| 4,800,965 | 1/1989 | Keller | 173/162.2 |
| 5,025,870 | 6/1991 | Gantner | 173/162.1 |
| 5,522,466 | 6/1996 | Harada et al. | 173/162.2 |
| 5,769,174 | 6/1998 | Lee et al. | 173/162.2 |

FOREIGN PATENT DOCUMENTS 104 154 3/1984 European Pat. Off. .

*Primary Examiner*—Scott A. Smith

*Attorney, Agent, or Firm*—Frishauf, Holtz, Goodman, Langer & Chick, P.C.

[57] ABSTRACT

A vibration-damped, machine driven tool includes a machine housing, a drive mechanism housed in the housing and operable to drive a tool projecting out from the housing, a carrier device which forms a cradle in which the machine housing is suspended, and a vibration damper coupling the carrier device to the machine housing. The machine housing and the tool are subjectable to an appropriately directed tool-feeding force via the carrier device so as to cause the tool to work on an outer workpiece. When the tool is at work, the drive mechanism generates vibrations. In order to reduce the vibrations, the vibration damper includes at least two pairs of leaf spring bridges which are fixedly mounted in abutment with the machine housing and with the cradle formed by the carrier device, and which are mutually spaced apart in a longitudinal direction of the cradle.

12 Claims, 3 Drawing Sheets

VIBRATION-DAMPED MACHINE DRIVEN TOOL

The present invention relates to vibration-damped machine driven tools of the kind that include a machine housing, a drive mechanism which is housed in the machine housing and which functions to drive a working tool projecting out from the housing, and a carrier in which the generation of vibrations by the drive mechanism and the tool at work is undesirable and which supports the machine housing through the medium of a vibration damper and by means of which an appropriately directed tool feeding force is brought to bear on the machine housing and the tool such as to cause the tool to carry out work.

BACKGROUND OF THE INVENTION

Machines such as mechanical breakers, drills, and mechanical tampers are examples of percussion tools whose vibrations, if they are not damped, are liable to reach levels that are harmful to the operator or to the supporting machinery. Vibration related problems also exist with other types of machines, for instance with heavy rotary drilling machines, motor saws, brush saws and shearing machines based on rotary or reciprocatory tool movement. Various vibration damping means have been proposed in an endeavour to overcome these problems. However, progressively sharpened standard requirements have meant that the solutions hitherto proposed in this regard fail to ensure that the tool or machine is sufficiently friendly to both workman and machinery.

Various types of spring devices have been used to dampen vibrations, including pneumatic devices, with subsequent undesirable air losses when damping vibrations, and more general elastic materials and steel springs. As an example of these two latter applications in hand-held percussion tools with different drive systems, reference can be made to Patent Specifications 1) EP/SE 0 104 154, 2) SE 226 416 and 3) U.S. Pat. No. 4,111,269. According to Patent Specification 1), handle vibrations are dampened with the aid of a rubber diaphragm. This damping effect is impaired, however, by rotary vibration and frictional forces generated between the outer surface of the machine and the front part thereof. Patent Specification 2) teaches a vibration damping solution which employs the use of a built-in helical spring. However, this solution is also encumbered with disturbing vibration-transmitting friction in the guides. Patent Specification 3) discloses non-linear leaf-spring damping, which is restricted to the furthest rearward handgrip, while balanced handling of the front part of the machine must be achieved in the absence of vibration damping.

OBJECT OF THE INVENTION

The object of the present invention is to provide a vibration-damped machine driven tool of the afore-described kind with which vibration damping is greatly improved and with which leaf springs are used to dampen vibration in all directions and also to support the tool during a working operation without being affected by friction. A further object is to make possible, in a non-lubricated and wear-free manner, purely linear damping of vibrations with positive transverse stability when aligning the machine in a working operation. This obviates at the same time the need to use rubber vibration damping material, whose damping effect is negatively effected by the internal development of heat, cold and moisture. These objects are achieved with a vibration dampened tool having the features set forth in the appended claims.

BRIEF DESCRIPTION OF THE DRAWINGS

The invention will now be described with reference to the five figures of the accompanying drawings, in which.

DETAILED DESCRIPTION

Figure 1:
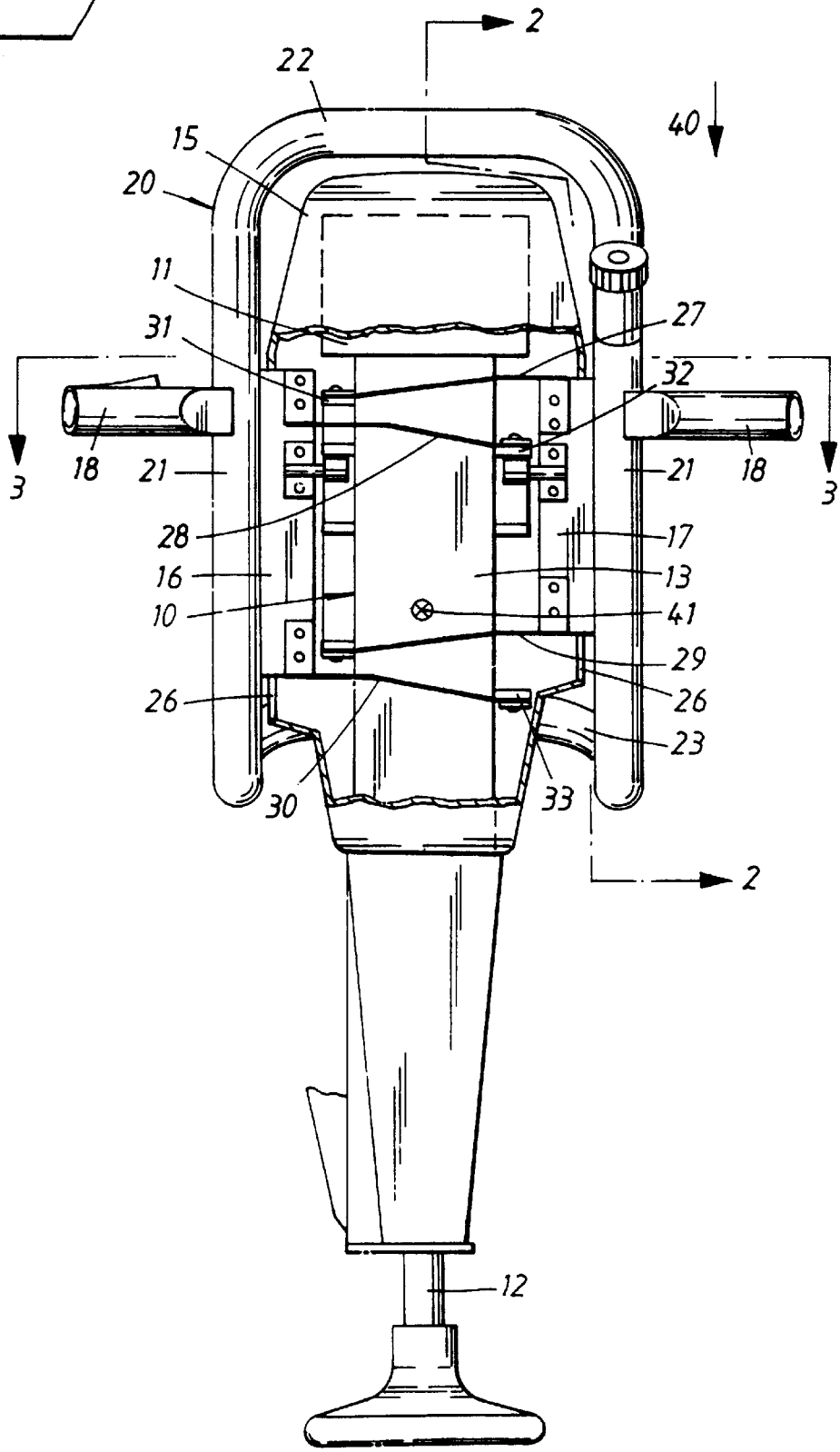
FIG. 1 illustrates an embodiment of the invention applied to a hand-held machine, a breaker, and shows the machine in an inactive state from the rear, i.e. that side from which the operator controls the machine. The protective casing of the machine has been partly cut away, to illustrate schematically the inner machine components more clearly.
Figure 2:
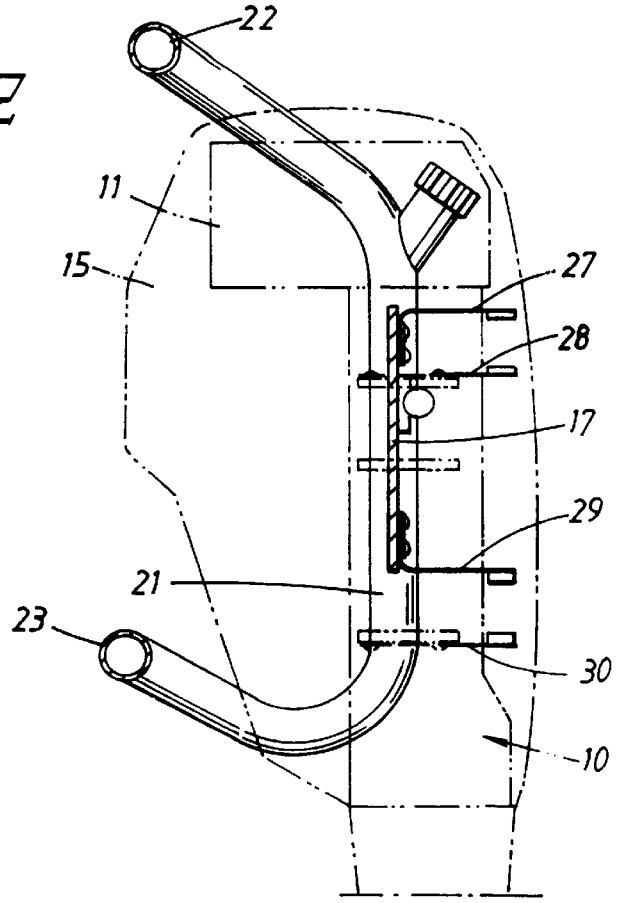
FIG. 2 is a sectional view taken on the line 2—2 in FIG. 1 and shows the contemplated tool contour above said section in chain lines.

The breaker tool shown in FIG. 1 includes a machine housing 10 the greater part of which is enclosed by a fixed protective casing 15 that extends around a schematically indicated drive motor 11 of suitable construction. In the illustrated exemplifying embodiment, there is used an internal combustion motor, although it will be understood that the invention can also be applied advantageously with pneumatically, hydraulically or electrically driven tool motors, of which an example is disclosed in Patent Specification 1) mentioned in the Background of the Invention. The drive motor 11 is constructed together with a hammer mechanism 13 which is designed to repeatedly strike a tool 12 projecting out from the machine housing 10, such as a tamper, chisel, drill, spade or breaker. The machine housing 10 and the hammer or impact mechanism 13 built in the machine housing may be of the kind described and illustrated in Patent Specification SE 8903624-8 and will not be described in m ore detail here.

Manual handling of the machine housing 10 is made possible by a carrier device 20 which surrounds the part of the machine housing that lies distal from the tool 12 and extends around the protective casing 15 and forms a frame or cradle structure 21–23 which is spaced from the protective casing 15 and which enables balanced horizontal and vertical alignment of the machine with the workpiece. The carrier device 20 includes mutually opposing side members 21 which extend along and around the machine housing in a longitudinal plane common with said housing. The cradle 21–23 is formed by connecting the side members 21 to at least two cross-members 22, 23 which bridge the machine housing 10 located therebetween, at opposite ends of the side members 21. In one preferred embodiment, the cradle 21–23 comprises of a continuous metal arcuate handgrip, preferably a tubular steel handgrip. The cross-members 22, 23 are inclined outwardly and forwardly in a direction away from the machine operator, so as to provide the best gripping position. In this regard, the upper cross member 22 forms a lifting and machine aligning handle at the rear end of the housing 10, while the cross member 23 forms a carrier handle by means of which the machine housing 10 is carried in a horizontal balanced state with said carrier handle 23 located above the region of its intermediate part and the centre of gravity of the machine, preferably inclusive of the tool 12. Laterally extending grips 18 are supported at mutually the same level by the side members 21. The downward tool-feeding force is applied to the machine housing 10 in the longitudinal direction of said housing and of the tool 12, by virtue of the operator pushing down on the side grips 18 in a conventional manner, as indicated by the arrow 40.

The cradle side members 21 carry in the common longitudinal plane mutually facing flanges 16, 17 which project into the fixed protective casing 15 via longitudinally extending slots 26. The flanges 16, 17 are secured in the machine housing 10 by vibration damping means, hereinafter described, so that the cradle 21–23 will always be dampened against vibrations when the machine is in use and during handling of the machine. The longitudinal slots 26 are therefore dimensioned so that when the machine is working, the flanges 16, 17 are always able to move freely and vibration-free in said slots, both longitudinally and transversely in relation to the protective casing 15.

Figure 3:
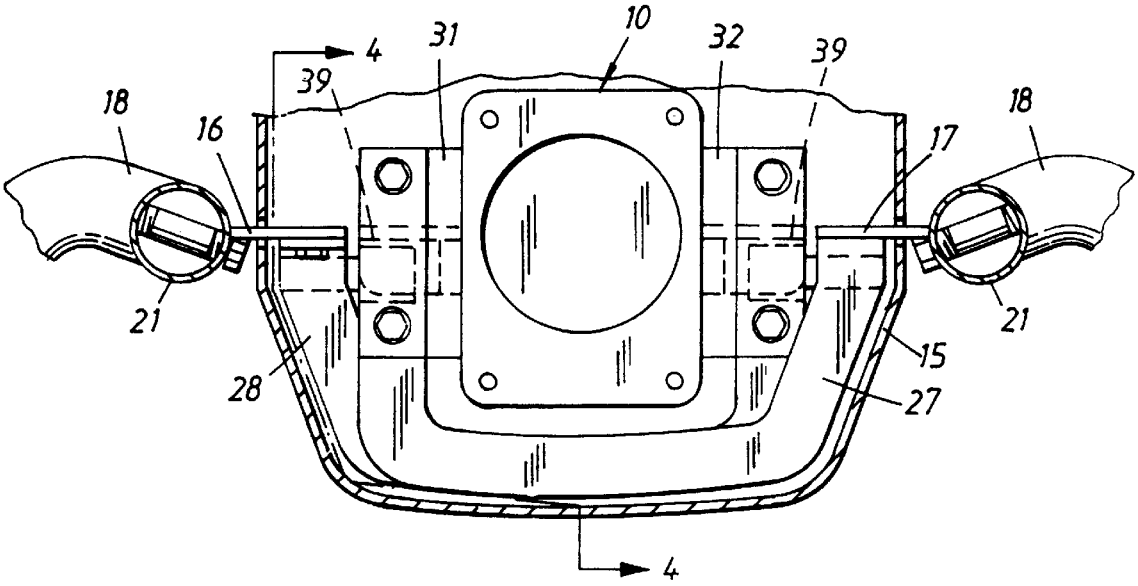
FIG. 3 is an enlarged partial sectioned view taken on the line 3—3 in FIG. 1.
Figure 4:
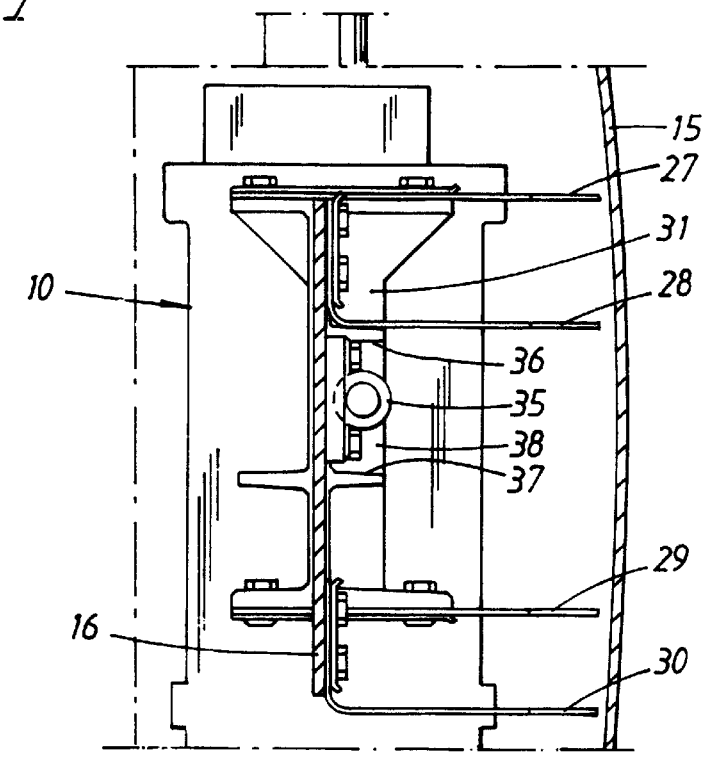
FIG. 4 is a partially sectioned view taken on the line 4—4 in FIG. 3 and shows the central elements of FIGS. 1, 2 in the working state of the machine, in which a tool feeding force is applied to the tool in its longitudinal direction.
Figure 5:
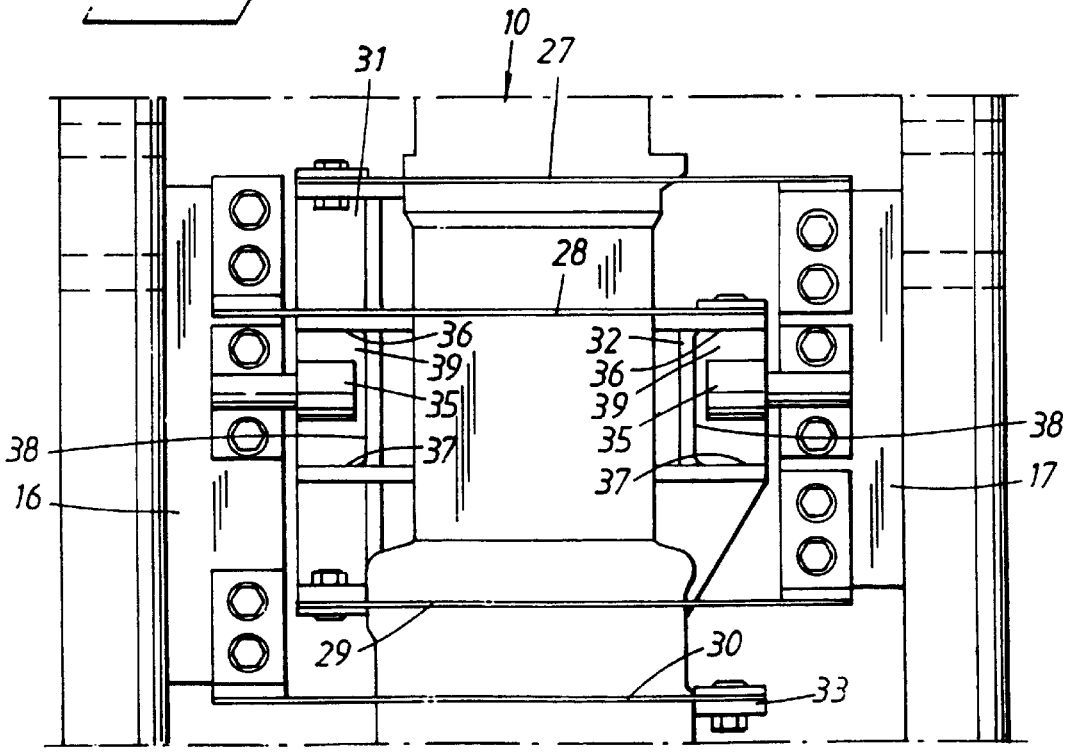
FIG. 5 is a view corresponding to the central view of FIG. 1 showing the elements in FIG. 4 in a working state.

The vibration damper comprises at least two leaf springs 27, 29 and 28, 30 which form bridges that connect the flanges 16, 17 on each side member 21 with the housing 10 lying therebetween, as will be seen more clearly from FIGS. 3–5. One pair of leaf springs 27, 29 extends from the attachments formed by the flange 17, past the intermediate housing 10 and out of contact therewith, to a side attachment 31 in the form of a bracket structure on the opposite side of the housing 10. Analogously, the other pair of leaf springs 28, 30 extends from the attachments formed by the flange 16 to the side attachment 32, 33 on the opposite side of the housing and out of contact with the intermediate machine housing 10. It will be seen that the leaves in the bridging part of the leaf springs 27–30 are placed in a plane that extends transversely to the feed direction 40 of the machine, so as to stabilize the machine against torsion in a lateral direction and to ensure purely parallel linear vibratory movement.

The leaf springs 27–30 are preferably fitted so as to lie between the machine operator and the machine housing 10 when the machine is at work, i.e. so that they are located substantially beneath the machine housing 10. The pairs of leaf springs 27, 29 and 28, 30 are also spaced mutually apart in the cradle 21–23 so that in a horizontal position the vertical projection of the centre of gravity 41 of the housing 10 will fall in the region between the side members 21 and the two outermost pairs of leaf springs 27, 28 and 29, 30 respectively. When necessary, the stability and balance of the machine can be further enhanced by mounting one or a pair of analogously arranged leaf spring bridges on, e.g., the rearmost part of the housing 10 between an upward vertical extension of the side members 21. The leaf springs 27–30 can be adapted in a positive sense with regard to their characteristics, natural frequency and resonance, by varying the cross-section, width and profile of the leaf springs 27–30, by pressing grooves therein and filling the grooves with a material such as polyurethane.

The leaf springs 27–30 are pre-tensioned in the cradle 21–23 so as to bias the cradle in a direction relative to the machine housing against the effect of the machine feeding force 40 applied to the machine housing when the machine is in operation. The magnitude of this biassing force is such that when an optimal tool feeding force is applied to the machine in carrying out work, the cradle 21–23 will be out of contact with the housing 10 and will be connected thereto solely via the leaf springs 27–30. This is achieved by providing an abutment in the form of stop members 36, 37 and intermediate coacting shoulders 35 between the flanges 16, 17 on the carrier device 20 and the respective side attachments 31, 32 of the machine housing 10. Optionally, one type of said members may be provided on the flanges 16, 17 and the other type on the adjacent side of the housing 10, or vice versa. The drawings show the variant in which shoulders 35 on both flanges 16, 17 engage between stop abutments 36, 37 in side apertures or recesses 38 on respective side attachments 31, 32 of the housing 10. When no machine feeding force is applied, the machine components take the inactive position shown in FIGS. 1. 2. in which the tension in the leaf springs holds the shoulders 35 in tight abutment with the upper stop abutments 36. When the machine is at work, with the tool-feeding force varying on average, the shoulders 35 take a general intermediate position between the stop abutment 36, 37 as shown in FIGS. 4, 5. In this state of the machine, the carrier device 20 is connected to the housing 10 solely via the leaf springs 27–30, by virtue of the clearance and freedom of movement afforded to the shoulders 35 in relation to the side attachments 31, 32. Optimal vibration damping of the entire carrier device 20 is achieved in this way. When extreme pressure is exerted on the tool 12 to move the tool towards and against the surface being worked, the shoulders are moved towards the front stop abutment 37, which limit the axial movement. The machine operator will not normally exert extreme tool-feeding pressure, since when contact is made with the surface requiring the application of such pressure, the operator will be warned immediately of this situation because the grips 18 will begin to vibrate in an uncontrolled manner. The illustrated leaf spring arrangement is rotatably rigid. Any extreme torsional forces will be taken up in the side apertures 38 as a result of the shoulders 35 lying against a respective side wall 39 extending between the stop abutments 36, 37.

It is also possible to arrange the stop abutments in a somewhat simpler manner on one side of the machine housing 10, with a common stop shoulder seated with free lateral play in a bracket slot that extends longitudinally in the tool-feed direction. The illustrated embodiment, however, causes less load to be placed on the shoulder and is to be preferred. The shoulders 35 may suitably be provided with impact-reducing plastic caps.

Although not shown, the cradle formed by the carrier device may alternatively form part of a handle of any convenient design, with a protective casing or without such, providing that the cradle is connected to the machine housing through the medium of leaf springs in accordance with the invention. The outer casing may be given a sound-damping and/or cooling air conducting function and built around the machine housing in spaced relationship therewith or guided around said housing (poorer vibration damping) Conventional handles of the kind disclosed, for instance, in U.K. Patent Specification 2,230,728 with or without an outer covering and carried by leaf springs in accordance with the invention can be used with lighter machines.

It will be understood that the invention can be conveniently applied to machines other than those mentioned above. Tests have shown the vibration damping afforded by the leaf spring arrangements according to the invention lie beneath the present permitted standard limits for hand vibrations. This enhanced protection can also be used in conjunction with machine equipment, e.g. for damping vibrations between a breaking tool and its heavily loaded mechanical supporting and aligning devices, and also in conjunction with mechanically advanced drilling machines between the machine and the machine carriage guided for movement along a feed beam.

I claim:

1. A vibration-damped, machine driven tool comprising:

a machine housing;

a drive mechanism housed in the housing and operable to drive a tool projecting out from the housing;

a carrier device which forms a cradle in which the machine housing is suspended; and a vibration damper coupling the carrier device to the machine housing;

wherein the machine housing and the tool are subjectable to an appropriately directed tool-feeding force via the carrier device so as to cause the tool to work on an outer workpiece;

wherein when the tool is at work the drive mechanism generates vibrations; and wherein the vibration damper comprises at least two pairs of leaf spring bridges which are fixedly mounted in abutment with the machine housing and with the cradle formed by the carrier device, and which are mutually spaced apart in a longitudinal direction of the cradle.

2. The tool according to claim 1, wherein each pair of leaf springs extends from a respective cradle attachment on a respective side of the housing to a respective side attachment on an opposite side of the housing, without contacting an intermediate portion of the machine housing, and wherein the leaf springs are positioned such that leaves thereof extend transversely to a direction of the tool-feeding force.

3. The tool according to claim 2, wherein the cradle attachments lie in substantially a same plane that extends longitudinally with respect to the machine housing.

4. The tool according to claim 2, wherein the machine housing is surrounded by an outer, fixed protective casing, and the cradle formed by the carrier device comprises mutually facing flanges which extend through openings in the protective casing, said flanges being freely movable and vibratable in the openings when the tool is at work.

5. The tool according to claim 2, wherein the leaf springs are pre-tensioned in the cradle so as to bias the cradle relative to the machine housing in a direction opposite to the direction of the tool-feeding force in a longitudinal direction of the tool when the tool is at work, and wherein a magnitude of the pre-tension is such that the cradle is connected to the tool solely via the leaf springs when the cradle is subjected to the tool-feeding force.

6. The tool according to claim 5, further comprising mutually coacting abutments disposed between the cradle and the machine housing, said abutments restricting any movement of the cradle relative to the machine housing that is induced by a biassing force of said leaf springs when the tool-feeding force is not applied, and said abutments being moved out of mutual contact and remaining out of mutual contact when the leaf springs are subjected to the tool-feeding force in carrying out normal work.

7. The tool according to claim 6, wherein the abutments each comprise a shoulder which is mounted on one of the cradle and a respective adjacent side of the machine housing, and coacting stop abutments which are mounted on the other of the cradle and the respective adjacent side of the machine housing.

8. The tool according to claim 7, wherein the shoulders engage in respective side apertures on the machine housing and first ends of each side aperture form first ones of the stop abutments, and wherein the side apertures comprises at least one longitudinal wall having lateral clearance for play in relation to the shoulders and which together with second, opposite ends of the respective side apertures form end stops which prevent overloading of the leaf spring when the tool-feeding force is exaggerated in the tool-feed direction and in a lateral direction of the machine housing.

9. The tool according to claim 1, wherein when the machine housing is positioned horizontally, a vertical projection of a center of gravity of the machine housing lies within the cradle between a longitudinally outermost one of the leaf springs.

10. The tool according to claim 2, wherein the tool forms part of a hand-held percussion machine in which side grips are mounted in side members of the cradle essentially in line with one another for applying the tool-feeding force to the machine housing manually via the cradle when the tool is at work, and wherein arcuate cross-members bridge the machine housing and join mutually opposite ends of the side members to form the cradle.

11. The tool according to claim 3, wherein the machine housing is surrounded by an outer, fixed protective casing, and the cradle formed by the carrier device comprises mutually facing flanges which extend through openings in the protective casing, said flanges being freely movable and vibratable in the openings when the tool is at work.

12. The tool according to claim 2, wherein when the machine housing is positioned horizontally, a vertical projection of a center of gravity of the machine housing lies within the cradle between a longitudinally outermost one of the leaf springs.

* * * * *